US007263757B2

(12) United States Patent
Herman

(10) Patent No.: US 7,263,757 B2
(45) Date of Patent: Sep. 4, 2007

(54) ELECTROMAGNETIC TRIMMING, FLANGING AND HEMMING APPARATUS AND METHOD

(75) Inventor: Edmund Arthur Herman, Shelby Township, MI (US)

(73) Assignee: General Motors Corporation, Detroit, MI (US)

( * ) Notice: Subject to any disclaimer, the term of this patent is extended or adjusted under 35 U.S.C. 154(b) by 170 days.

(21) Appl. No.: 10/924,499

(22) Filed: Aug. 24, 2004

(65) Prior Publication Data

US 2005/0229376 A1 Oct. 20, 2005

Related U.S. Application Data

(60) Provisional application No. 60/562,853, filed on Apr. 15, 2004.

(51) Int. Cl.
*B23P 11/00* (2006.01)
*B21D 26/00* (2006.01)

(52) U.S. Cl. ..... 29/509; 29/419.2; 29/513; 29/469.5; 29/243.5; 29/283.5; 72/55; 72/381; 219/602; 219/659

(58) Field of Classification Search ..... 29/509, 29/513, 514, 521, 469.5, 243.5, 243.58, 283.5, 29/281.5, 24.5, 419.2; 219/602, 646, 647, 219/659; 72/55, 312, 381
See application file for complete search history.

(56) References Cited

U.S. PATENT DOCUMENTS 4,531,393 A * 7/1985 Weir ..... 72/56
4,602,139 A * 7/1986 Hutton et al. ..... 219/603
4,650,947 A * 3/1987 Hutton et al. ..... 219/603
4,654,495 A * 3/1987 Hutton et al. ..... 219/603
4,950,348 A * 8/1990 Larsen ..... 156/275.3
5,237,734 A * 8/1993 Polon ..... 29/513
5,365,041 A * 11/1994 Shank ..... 219/633
5,647,243 A * 7/1997 Zampini ..... 72/452.6
5,826,320 A * 10/1998 Rathke et al. ..... 29/419.2
5,966,813 A * 10/1999 Durand ..... 29/897.2
6,029,334 A * 2/2000 Hartley ..... 29/464
6,052,887 A * 4/2000 Dziadosz et al. ..... 29/509
6,389,697 B1 * 5/2002 Benoit et al. ..... 29/897.2
6,578,401 B2 * 6/2003 Baulier ..... 72/312
6,927,370 B2 * 8/2005 McClure et al. ..... 219/603
7,026,585 B2 * 4/2006 Yablochnikov et al. ..... 219/602
7,051,566 B2 * 5/2006 Baulier et al. ..... 72/306
7,127,816 B2 * 10/2006 Kiehl ..... 29/897.2
2005/0229377 A1 * 10/2005 Bradley et al. ..... 29/509

* cited by examiner

*Primary Examiner*—Essama Omgba

(57) ABSTRACT

Electromagnetic (EMF) trimming, flanging and hemming steps are performed at a single workstation in a combined fixture designed to form a hemmed panel assembly, such as a vehicle closure panel. Two or more formed sheets, outer and inner panels, are positioned together for hemming. The panels are clamped and EMF coils are activated to provide EMF force to retain the panels and trim off excess addendum material from the outer panel. The coils are then activated to bend the trimmed edge upward against a flanging member and form a 90 degree flange. Flanging and trimming members are retracted and a coil member positions EMF hemming coils opposite the flange. The hemming coils are then activated and apply EMF force to bend the flange of the outer panel to a 180 degree angle, overlaying the edge of the inner panel and forming a panel assembly having a hemmed edge. Optionally, if needed, the flanging member is then lowered against the flange to assure flatness of the hem.

8 Claims, 5 Drawing Sheets

Flange

Hem

ELECTROMAGNETIC TRIMMING, FLANGING AND HEMMING APPARATUS AND METHOD

CROSS-REFERENCE TO RELATED APPLICATIONS

This application claims priority from U.S. Provisional Patent Application No. 60/562,853 filed Apr. 15, 2004.

TECHNICAL FIELD

This invention relates to trimming, flanging and hemming the edges of inner and outer closure panels and the like to form a hemmed assembly having closed edges. More particularly, the invention relates to a single station electromagnetic (EMF) trimming, flanging and hemming apparatus and methods.

BACKGROUND OF THE INVENTION

A prior art method consists of a sequence of separate die operations as shown in FIGS. 8-11. In those figures, the sheet metal parts only are shown. The dies that form the parts are not shown.

FIG. 8 illustrates the first die operation for drawing a flat piece of sheet metal into the form of a first part, such as an outer panel 80. The shape of the formed part is not shown since that form is irrelevant to this invention as the purpose here is to assemble the first part to a second part by hemming the edge of the first part. But, what is shown is the addendum 82 that is required to accomplish forming of the part in a drawing die and which must be trimmed off later.

FIG. 9 shows the addendum 82 being trimmed away from the material that actually forms the part 80. Next a flange 84 is formed along the edge of the part 80 as shown in FIG. 10.

Each of these three operations is performed in a separate die. The piece of sheet metal is moved into the first die, and then from die to die and finally out of the third die in the process.

Finally, the flanged panel 80 is positioned in a hemming die, as indicated by the phantom line flange 84 in FIG. 11, and a second part, such as an inner panel 86, is positioned in place on the first part 80. Then the hemming die folds the flange 84 into a hemmed edge 88, entrapping the inner panel 86 and securing it to the outer panel 80 to form a panel assembly 90.

Shortcomings of the prior art process are (1) it requires three forming dies and one hemming die, (2) the piece of sheet metal must be moved at least five times and (3) there are three opportunities for mislocation of the part in a forming or hemming die with resulting defective forming or hemming. Also, the prior art method requires a less desirable "rope" hem when the parts are made of aluminum sheet.

The technology for applying electromagnetic forces and the configuration of the coils exists in prior art. The forming and trimming of sheet metal with electromagnetics is believed to have been demonstrated.

Electromagnetic forming uses very high-current pulses in a specially designed electrical coil to generate magnetic fields, which impart opposing currents and magnetic fields in a highly electrically conductive metal workpiece, such as an aluminum alloy. With the coil held in a fixed position, the repulsive magnetic forces act upon the workpiece causing it to deform at very high strain rates. Metals deformed at these very high strain rates can exhibit "hyperplasticity," a level of plastic ductility well beyond what the material is capable of during conventional forming, e.g., flanging and hemming operations.

There was a perceived need for developing a single station fixture and methods for trimming, flanging and hemming of panels into panel assemblies for vehicle doors and other closures. The development of apparatus and methods for applying electromagnetic forces to the trimming, forming and hemming of panel assemblies was also desired.

SUMMARY OF THE INVENTION

The present invention provides a novel application of electromagnetic (EMF) trimming and forming to form a hemmed panel assembly, such as a vehicle closure panel. A single EMF trimming and forming apparatus or fixture is provided in which two or more formed sheets, outer and inner panels, are positioned together for hemming. The parts are clamped and EMF coils are activated to provide EMF force to retain and trim off excess addendum material from the outer panel.

The coils are then activated and apply electromagnetic force to bend the trimmed edge upward against a flanging member and form a 90 degree flange. Flanging and trimming members are retracted and a coil member positions EMF hemming coils opposite the flange.

The hemming coils are then activated and apply EMF force to bend the flange of the outer panel to a 180 degree angle, overlaying the edge of the inner panel and forming an assembly 86 having a hemmed edge 88. Optionally, if needed, the flanging member is then lowered against the flange and exerts mechanical force to assure flatness of the hem.

These and other features and advantages of the invention will be more fully understood from the following description of certain specific embodiments of the invention taken together with the accompanying drawings.

BRIEF DESCRIPTION OF THE DRAWINGS

FIG. 8 shows a formed outer panel after drawing;

FIG. 9 shows the panel after trimming;

FIG. 10 shows the panel after flanging; and

FIG. 11 shows hemming to form a panel assembly.

DESCRIPTION OF THE PREFERRED EMBODIMENT

Figure 1:
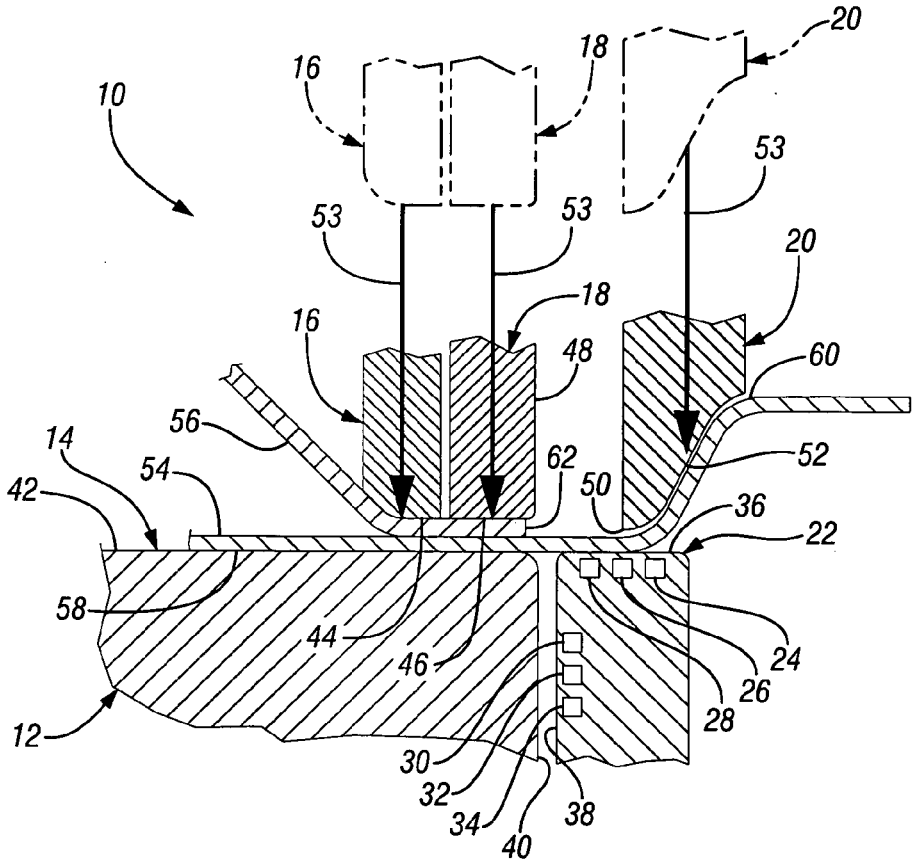
FIG. 1 is a fragmentary side elevational view of a trimming, flanging and hemming fixture according to the invention and illustrating initial steps in placing and securing metal panels for forming a hemmed panel assembly therein.

Referring now to the drawings in detail, numeral 10 generally indicates a workstation for producing hemmed panel assemblies. Positioned in the workstation 10 is a trimming, flanging and hemming apparatus or fixture 12.

The fixture 12 includes a stationary nest 14 supported on a suitable base, not shown. Also, preferably, supported by the base 12 and associated with the nest 14 are several movable members including a clamp member 16, a flange forming member or flanging member 18, a trimming member 20 and an electromagnetic coil positioning member 22, subsequently referred to as the coil member. The movable members are moved or actuated by any suitable means known in the art for the support and actuation of conventional forming and clamping members in press and die assemblies or equivalent mechanisms.

The coil member 22 may carry several electromagnetic coils, including, for example, a holding coil 24, a trimming and flanging coil 26, a flanging coil 28 and three hemming coils 30, 32, 34. The holding, trimming and flanging coils 24, 26, 28 are longitudinally spaced in or adjacent an upper face 36 of the coil member 22 and the hemming coils 30, 32, 34 are vertically spaced in or adjacent a side face 38 of the coil member 22. The coil member 22 is movable to an upper position for purposes to be subsequently described.

The nest 14 has a side 40 that spacedly opposes the side face 38 of the coil member 22. An upper surface 42 of the nest is positioned in general alignment with the upper surface 36 of the coil member 22 in its initial lower position as shown in FIG. 1. The clamp member 16 has a lower clamping surface 44, the flanging member 18 has a lower clamping surface 46 and an outer side 48, and the trimming member 20 has a lower trimming edge 50 and a formed lower surface 52.

The clamp and flanging members 16, 18 are movable from their initial lower clamping positions, shown in FIG. 1, to open upper positions. Similarly, the trimming member 20 is movable from a lower trimming position of FIG. 1 to an upper clearing position.

For loading the fixture, the clamp member 16, the flanging member 18, and the trimming member 20, are initially positioned in their upper positions, a distance 53 above the nest 14 and coil member 22. Distance 53 must be adequate to facilitate the placing of sheet metal parts into the fixture and removing them after hemming assembly.

Figure 8:
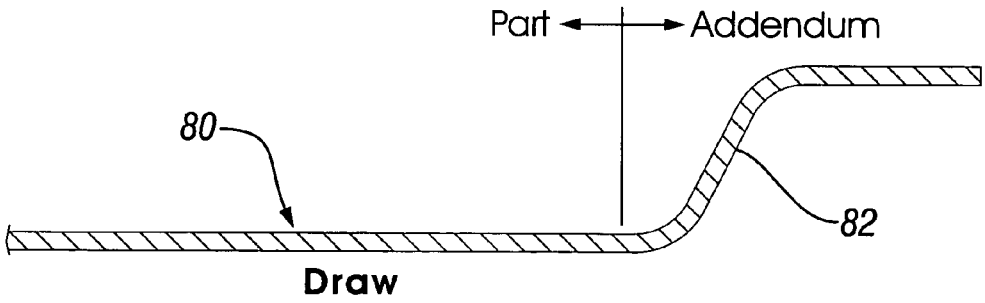
PRIOR ART FIG. 8
FIGS. 8-11 are side elevation views illustrating prior art steps in forming of a hemmed panel assembly.
Figure 9:
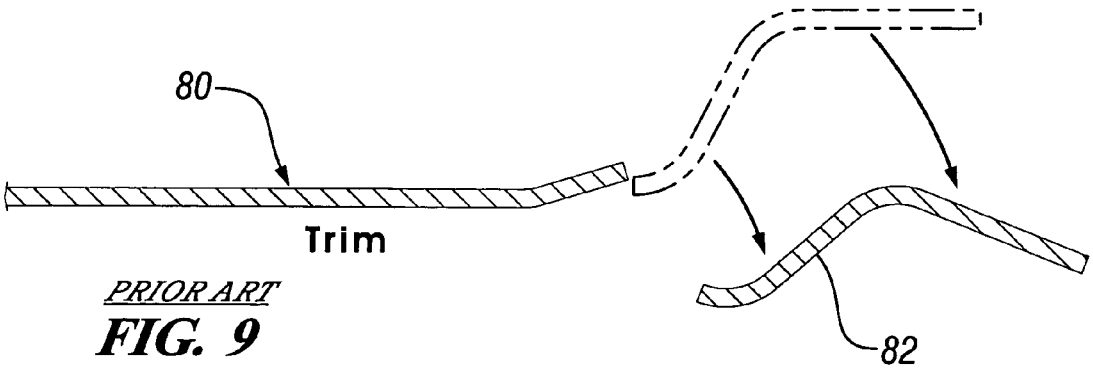
PRIOR ART FIG. 9
Figure 10:
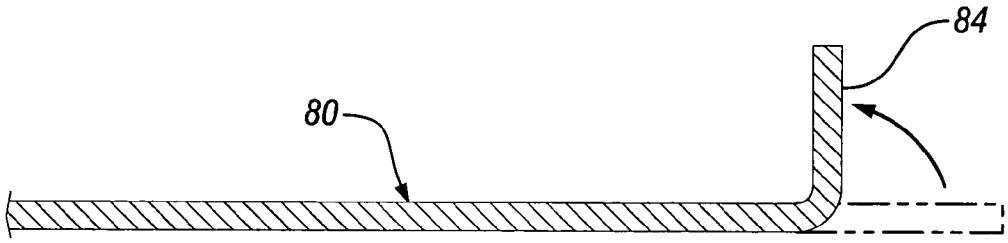
PRIOR ART FIG. 10
Figure 11:
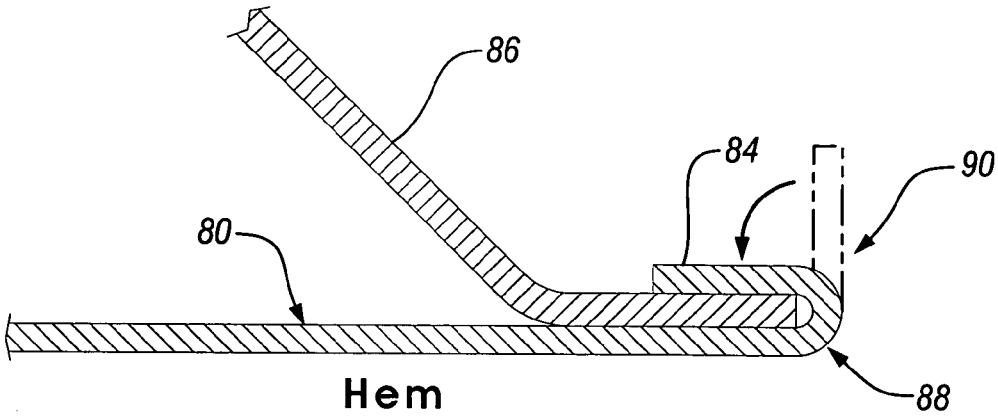
PRIOR ART FIG. 11

Sheet metal panels, including an outer panel 54 and an inner panel 56, are formed by any suitable method, for example, by the prior art drawing step described in connection with FIG. 8 following. The preformed panels are then utilized with the fixture 12 in carrying out the method of the present invention.

The formed outer panel 54 is positioned with an outer surface 58 lying against the upper surface 42 of the nest 14 and extending onto the upper face 36 of the coil member 22 with an addendum 60 positioned under the trimming member lower surface 52. The formed inner panel 56 is then positioned on top of the outer panel 54, with an edge portion 62 located slightly inward of or even with the sides 40, 48 of the nest 14 and the flanging member 18, respectively.

The clamp member 16, flanging member 18 and trimming member 20 are then lowered the distance 53 so that the clamp and flanging members engage the inner panel and hold the panels together against the nest with force adequate such that they will not move relative to the nest 14 during subsequent trimming, flanging and hemming actions. The trimming member 20 is also lowered to just above the addendum 60 and held with sufficient rigidity to withstand the subsequent force of trimming.

Figure 2:
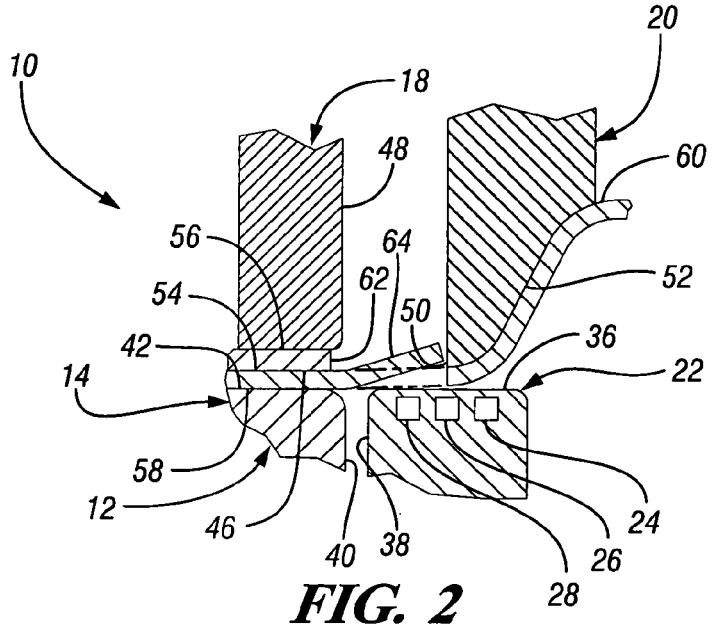
FIG. 2 is a view similar to FIG. 1 but illustrating a trimming step.

The first action in the electromagnetic forming sequence is shown in FIG. 2. An electric current with sufficient amperage, voltage and pulse time is passed through coil 24 to apply sufficient clamping force 16 to hold the sheet metal addendum against the trimming edge 50 of the trimming member. At the same time, an electric current with sufficient amperage, voltage and pulse time is passed through coil 26.

The electrical currents in coils 24 and 26 create magnetic flux fields, which in turn induce eddy currents in the outer panel 54. The eddy currents create secondary magnetic flux fields, which repel from the primary fields of coils 24 and 26. The repulsive force from coil 24 forces the addendum 60 of the outer panel to clamp securely to the trimming member 20 and the repulsive force from coil 24 drives the outer panel 54 against the sharp trimming edge 50 of the trimming member 20; separating the addendum 60 from the outer panel 54. This then leaves a flange 64 formed by the portion of panel 54 that extends beyond the side 40 of the nest and ends adjacent the trimming edge 50 of the trimming member 20.

Figure 3:
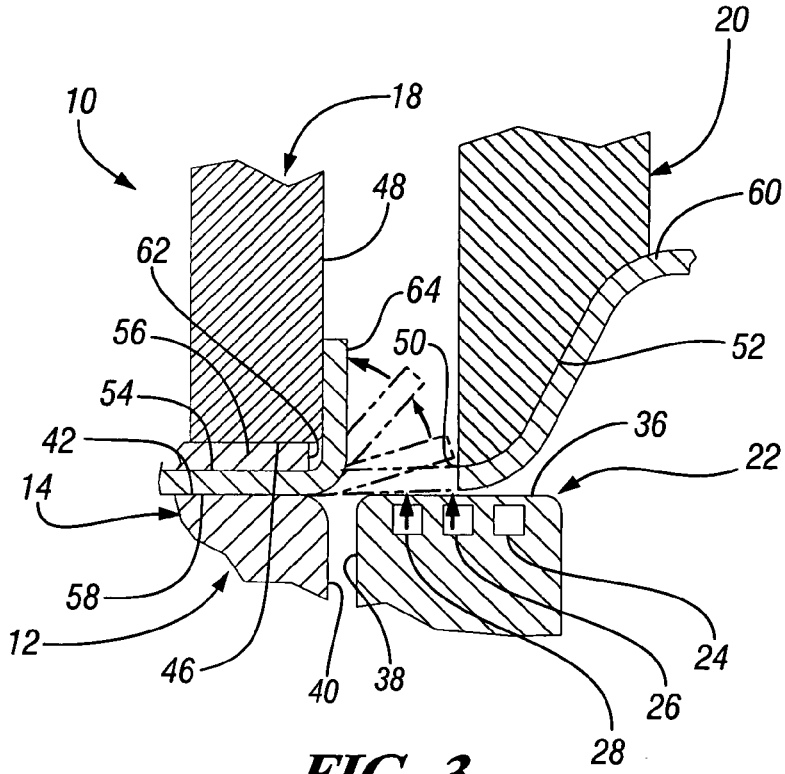
FIG. 3 is a view similar to FIG. 2 but illustrating a flanging step.
Figure 4:
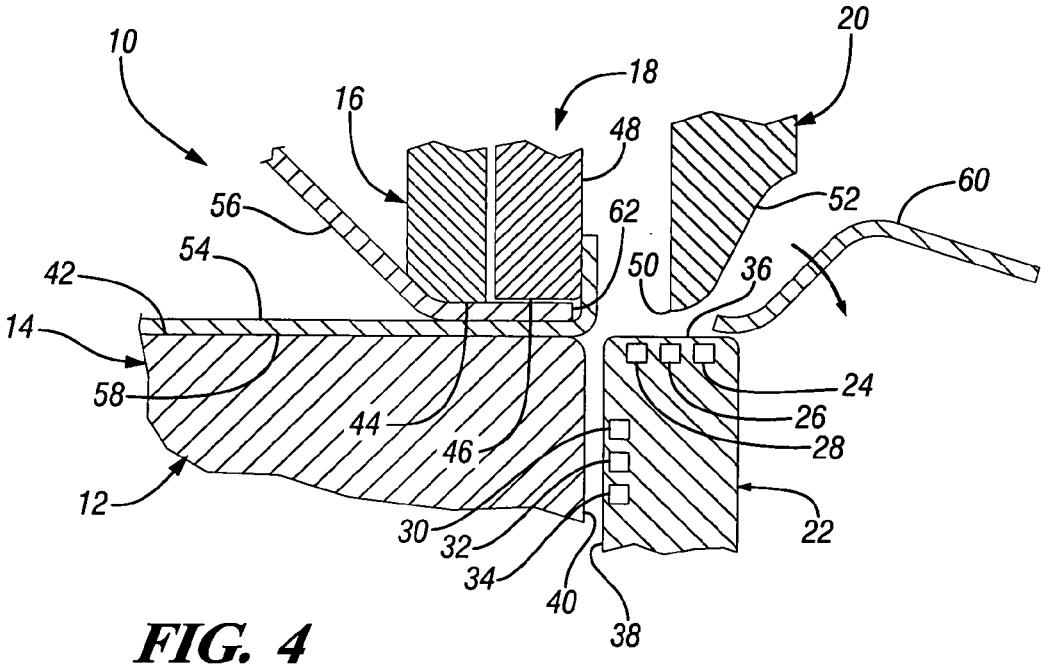
FIG. 4 is a view similar to FIG. 3 but illustrating a trim release step.

Referring to FIG. 3, the repulsive force from coil 26 continues to drive the flange 64 up into the space between the flanging member 18 and trimming member 20. Additional repulsive force is added as necessary by a current through coil 28, acting with the same electromagnetic mechanism as that in coils 24 and 26. The reaction forces within the flange 64 and the kinetic energy of the induced motion cause the flange to bend 90 degrees to lie against the side 48 of the flanging member 18 as shown in FIG. 4. Also, the addendum 60 of the outer panel 54 falls away, having been severed from the rest of the outer panel 54.

Figure 5:
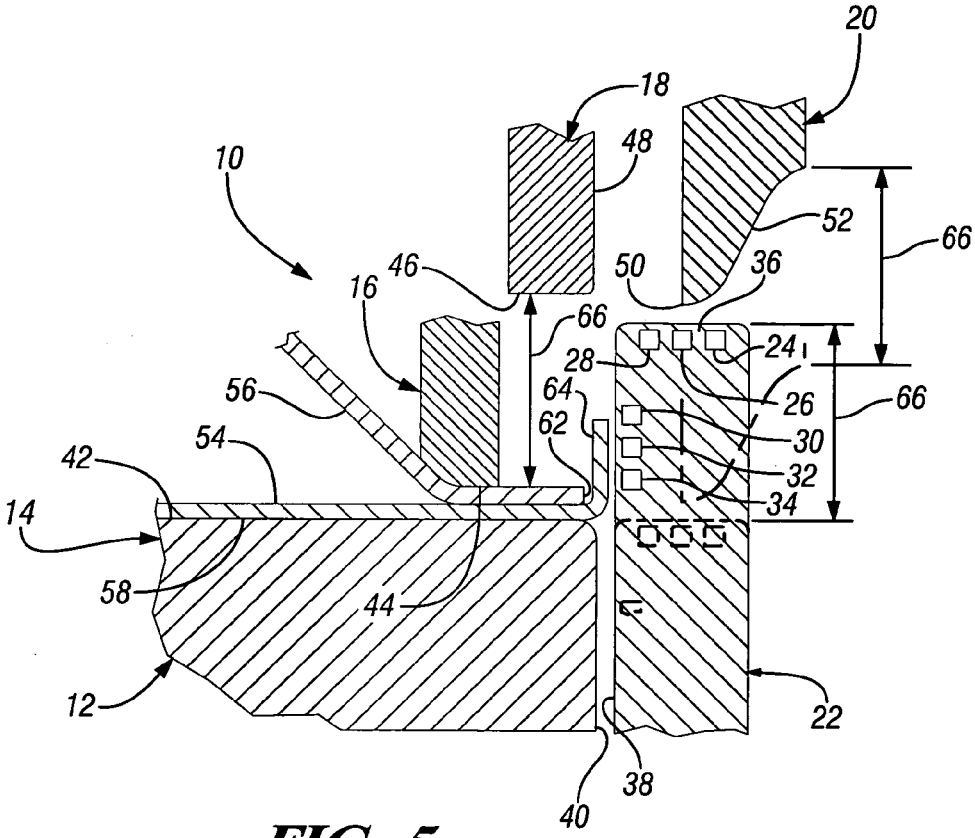
FIG. 5 is a view similar to FIG. 4 but illustrating a prehemming position of the fixture.

Referring to FIG. 5, the flanging member 18, trimming member 20 and the coil member 22 are then raised a distance 66 relative to the nest upper surface 42 and the clamp 18, which continues to hold the panels 54, 56 together on the nest 14. Coils 30, 32 and 34 are now positioned adjacent to the formed flange 64 on the outer panel 54.

Figure 6:
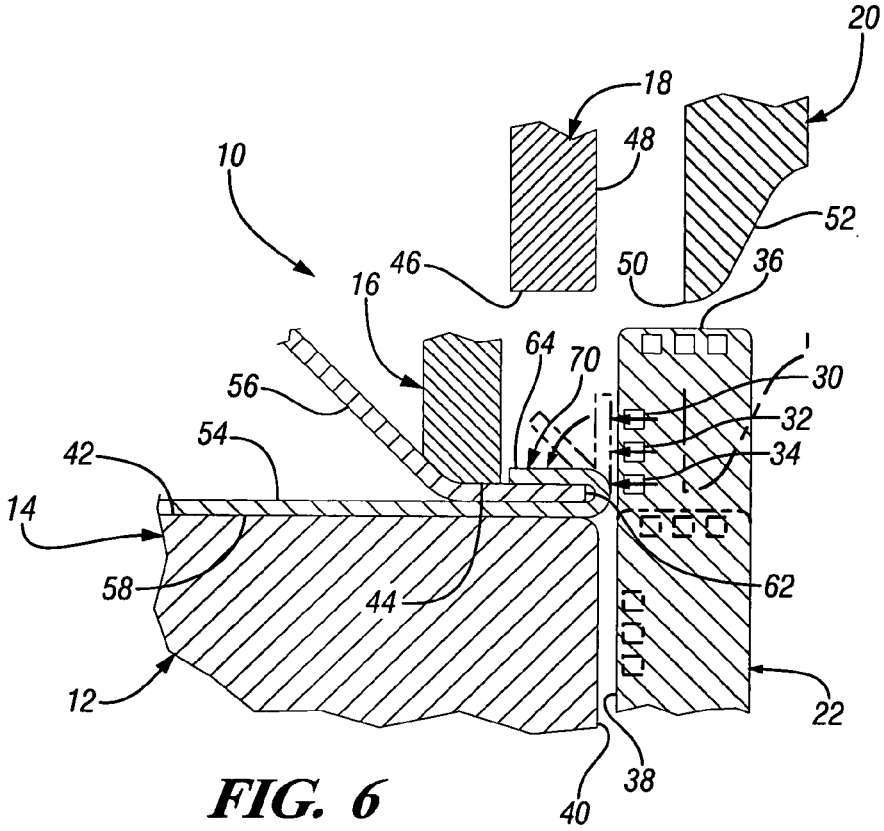
FIG. 6 is a view similar to FIG. 5 but illustrating a hemming step.

Referring to FIG. 6, an electric current with sufficient amperage, voltage and pulse time is passed through coils 30, 32 and 34, creating sufficient repulsive force to drive the flange 64 into the final hemmed position against the trimmed end portion 62 of the inner panel 56.

Figure 7:
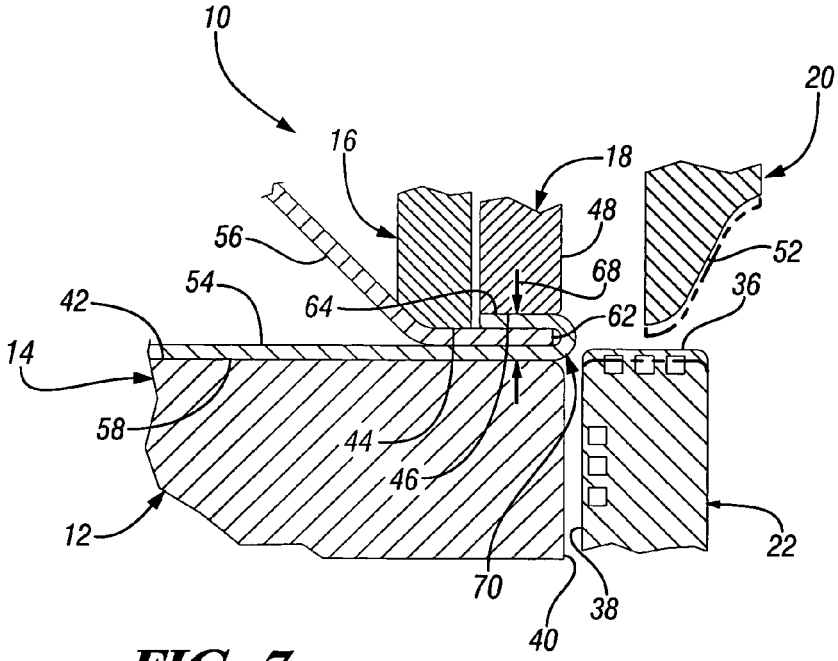
FIG. 7 is a view similar to FIG. 6 but illustrating an optional hem finishing step.

Referring to FIG. 7, an optional feature is to have the flanging member 18, trimming member 20 and coil member 22 returned toward their initial positions, shown in FIG. 1, with the flanging member 18 coming to rest on flange 64 before reaching the previous position. The trimming member 20 and the coil member 22 can also stop moving when the flanging member 18 stops, or they can return to their previous positions, depending on the mechanism(s) that move them. The flanging member can then exert a force 68 onto the hem to insure flatness if necessary.

Finally, the clamp 16, flanging member 18 and trimming member 20 are returned to their initial "Open" positions, shown in phantom in FIG. 1. The hemmed panels form a panel assembly 70, which is removed from the open fixture 12 and the cycle is repeated with a new set of panels.

Use of the novel fixture and method of the invention will eliminate two dies along with the associated costs of those dies and the costs of moving the parts between them. The method will also eliminate errors caused by improper location of the parts in the dies. The method can accomplish the trimming, flanging and hemming steps in the time presently used for hemming alone.

Furthermore, electromagnetic forming (EMF) has been shown to increase significantly the forming limit of aluminum sheet. Thus, the novel method will facilitate longer flanges and hence more hem overlap in some instances. The method will produce "flat" hems with aluminum.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A method of applying electromagnetic force (EMF) for hemming together edges of at least two metal panels to form an edge hemmed panel assembly, the method comprising:

holding at least first and second metal panels with edges aligned in mated face engagement, the first panel having a flange portion bent at an angle from the mated edge of the first panel across and beyond the mated edge of the second panel;

positioning an EMF hemming coil closely opposite an outer face of the flange; and energizing the coil to generate eddy currents in the flange that form opposing magnetic fields in the flange and bend the flange away from the coil to form a finished hem of the first panel around an associated edge of the second panel;

wherein the holding step includes holding the panels in a combined trimming, flanging and hemming fixture and the method steps include:

energizing an EMF holding coil to hold an addendum portion of the first panel against a trimming member;

energizing an EMF trimming and flanging coil to trim the addendum portion from the flange by forcing the flange against a sharp edge of the trimming member and bending the flange to said angle by continued EMF force of the second coil; and moving a coil member carrying the hemming coil to position the hemming coil opposite the flange and performing the energizing step to form the finished hem.

2. A method as in claim 1 wherein the hemming coil extends for about the length of the flange to fold the entire flange together in plane strain bending, the formability of the flange being increased by the increased temperature of the flange resulting from the eddy currents generated in the flange.

3. A method as in claim 2 wherein the flanging coil also extends for about the length of the flange to also bend the entire flange together to said initial angle in plane strain bending.

4. A method as in claim 1 including pressing the hem to mechanically flatten and smooth the finished hem.

5. Hemming apparatus for attaching panel edges in face to face assembly by folding an angled flange adjacent an edge of a first panel over a mated edge of a second panel to form a hemmed panel assembly, the apparatus comprising:

a hemming portion including at least one electromagnetic (EMF) hemming coil adapted to be positioned adjacent the flange and operative to magnetically repel the flange to effectively engage the flange with an outer side of the mated edge of the second panel and thereby maintain the panels in assembly;

wherein the hemming coil is mounted on a coil member of a combined trimming, flanging and hemming fixture;

the hemming apparatus further including a nest for receiving the first and second panels to be hemmed;

a clamp for holding the panels in position on the nest;

a flanging member adjacent the clamp;

a trimming member positioned above an addendum portion of the first panel; and a coil member carrying holding and trimming coils as well as the flanging and hemming coils;

the holding and trimming and flanging coils being positioned on an end of the coil member initially disposed opposite addendum and flange portions of the first member to hold the addendum portion against the trimming member while forcing the flange portion against a cutting edge to trim the addendum and form an angled flange; and the hemming coils being positioned in a side of the coil member which is raised after trimming to position the hemming coils opposite the angled flange for bending the flange against the second panel in a hemming motion.

6. Hemming apparatus for attaching panel edges in face to face assembly by forming an angled flange adjacent an edge of a first panel and folding the angled flange over a mated edge of a second panel to form a hemmed panel assembly, the apparatus comprising:

a nest for receiving the first and second panels to be hemmed;

a clamp effective to hold the panels in position on the nest;

a flanging member adjacent the clamp and movable between clamping and released positions;

at least one coil member carrying electromagnetic flanging and hemming coils, the at least one coil member being movable between a flanging position wherein the flanging coil is positioned adjacent the flange prior to bending the flange to a specified angle and the hemming coil is positioned adjacent the angled flange prior to folding the flange over the mated edge of the second panel to form a hemmed panel assembly.

7. Hemming apparatus as in claim 6 wherein the flanging member has a lower clamping surface and an outer side, the lower clamping surface being operative in the clamping position to engage the second panel and fix the flanging member relative to the panels, and the outer side being operative as a stop controlling bending of the flange to the specified angle.

8. Hemming apparatus as in claim 7 wherein the first panel also includes an addendum portion initially extending from a flange portion of the first panel;

wherein the hemming apparatus also includes a trimming member having a sharp edge engageable with the addendum portion adjacent the flange portion prior to performing trimming and flanging, and the coil member also carries a holding coil and a trimming coil adjacent the flanging coil in an end of a coil member initially facing the first panel, the holding coil being operative to electromagnetically hold the addendum portion against the trimming member while the trimming coil and flanging coil generate electromagnetic force that moves the flange portion against the sharp edge and trims off the addendum portion while bending the flange portion upward against the side of the flanging member to form the flange and establish a predetermined angle for the flange.

* * * * *